United States Patent [19]

Ishimoto et al.

[11] Patent Number: 4,840,557

[45] Date of Patent: Jun. 20, 1989

[54] VERTICAL INJECTION APPARATUS

[75] Inventors: Kenji Ishimoto; Kouji Kawabata, both of Ube, Japan

[73] Assignee: UBE Industries, Ltd., Ube, Japan

[21] Appl. No.: 125,549

[22] Filed: Nov. 25, 1987

[30] Foreign Application Priority Data

Dec. 1, 1986 [JP] Japan ..... 61-284155
Jan. 8, 1987 [JP] Japan ..... 62-1055

[51] Int. Cl.[4] ..... B29C 45/34

[52] U.S. Cl. ..... 425/555; 425/556; 425/577

[58] Field of Search ..... 425/139, 555, 556, 576, 425/577, 589, 553

[56] References Cited

U.S. PATENT DOCUMENTS

| | | | |
|---|---|---|---|
| 3,575,233 | 4/1971 | Mahle | 425/577 |
| 4,088,178 | 5/1978 | Ueno | 164/314 |
| 4,287,935 | 9/1981 | Ueno | 164/314 |
| 4,431,047 | 2/1984 | Takeshima et al. | 164/305 |
| 4,515,342 | 5/1985 | Boskovic | 425/577 |
| 4,538,666 | 9/1985 | Takeshima et al. | 164/410 |
| 4,563,324 | 1/1986 | Kubat et al. | 425/555 |
| 4,655,274 | 4/1987 | Dannoura | 425/556 |

FOREIGN PATENT DOCUMENTS

| | | |
|---|---|---|
| DE3100463 | 1/1981 | Fed. Rep. of Germany . |
| 55-42116 | 3/1980 | Japan . |
| 56-5621 | 1/1981 | Japan . |

*Primary Examiner*—Jay H. Woo
*Assistant Examiner*—Timothy N. Heitbrink
*Attorney, Agent, or Firm*—Finnegan, Henderson, Farabow, Garrett & Dunner

[57] ABSTRACT

A vertical injection apparatus is incorporated with a parting mold including upper and lower mold halves and defining a cavity to be filled with a melt. The lower mold half has a vertical sleeve hole at the outer side thereof and a vertical melt passage hold communicating between the cavity and the sleeve hole. The upper mold half has a vertically extending pin hole coaxial with the melt passage hole and open to the cavity and provided with a vertically extending mold pin movable through the pin hole. At least an upper part of the melt passage hole in the vicinity of the cavity has a diameter smaller than that of the sleeve hole but slightly large than the of the mold pin. Preferably, the cavity is designed for a disk wheel having a central hole through which the mold pin is allowed to pass, and the lower mold half forms a contoured inner surface corresponding to a decorated surface of the disk wheel. After the melt in a sleeve is injected by a plunger into the cavity through the melt passage hole, the mold pin is forced to move to a lower position so that a lower free end portion of the mold pin is inserted into the melt passage hole through the cavity, thus urging the melt filled in the cavity and the melt passage hole against the surface of the cavity.

10 Claims, 8 Drawing Sheets

VERTICAL INJECTION APPARATUS

BACKGROUND OF THE INVENTION

1. Field of the Invention

The present invention relates to a vertical injection apparatus incorporated with a mold defining a cavity into which a melt is injected from just below the cavity, and more particularly, to a cavity designed for a mold product such as a disk wheel having a central hole.

2. Description of the Related Art

The casting of an automobile disk wheel of aluminum is often performed by a vertical die casting machine because an inclusion of gas at the melt-injecting step is thus reduced. FIG. 6 (prior art) is a schematic diagram illustrating the longitudinal section of a mold and an injection apparatus in a conventional die casting machine of this type. This conventional machine will now be described with reference to FIG. 6. A lower mold half 112 having a cylindrical convex part at the center is attached to a stationary platen 111 secured on a machine base, and an upper mold half 114 having a low convex part at the center is attached to a vertically movable platen 113 supported on a moldclamping cylinder (not shown). A plurality of cores 115 are inserted between both the molds halves 112 and 114 from a plurality of positions in the circumferential direction so that the cores 115 can move in the horizontal direction in accordance with the advance and retreat of a piston rod 117 of a cylinder 116 supported on the side of the movable platen 113. A cavity 118 is defined by both the mold halves 112 and 114 and the plurality of cores 115. An injection sleeve 119 is freely extractably inserted from below into a sleeve hole formed in the stationary platen 111 and the lower mold half 112, and a plunger tip 120 is fitted in the injection sleeve 119 so that the plunger tip 120 can be advanced and retreated by an injection cylinder (not shown). A melt 121 is cast in the state where the injection sleeve 119 is extracted from the sleeve hole.

By adopting the above-mentioned structure, if the melt 121 is cast in the injection sleeve and the plunger tip 120 is inserted into the sleeve hole and then advanced, the melt is injected into the cavity 118, and after the melt 121 is solidified and cooled, the movable platen 113 is raised and the molds are opened. Simultaneously, the cores 115 are opened sideways and a product solidified in the cavity is pushed out and withdrawn from the machine by a product push-out apparatus (not shown).

For explaining the flow of the melt 121 in the cavity 118 at the injection operation, a disk portion **118*a* of the cavity 118 corresponding to a disk of a disk wheel in FIG. 6 has diagrammatically a disk-like shape as shown in FIG. 7, attached hereto and a rim portion 118*b* of the cavity 118 has diagrammatically a cylindrical shape as shown in FIG. 8, attached hereto. The melt 121 raised by the plunger tip 120 flows radially in the disk portion 118*a* as indicated by an arrow in FIG. 7 and drops down under its own weight in the rim portion 8*b* as indicated by an arrow in FIG. 8. FIG. 9 attached hereto is a perspective view showing the state of the melt flowing in this manner. While the melt 121 thus flowing drops down in the rim portion 118*b*, coarse and dense portions are formed in the melt flow because of a temperature unevenness in the mold halves 112 and 114, an adhesion unevenness of a parting agent, and scratches on the surfaces of the mold halves 112 and 114. Gas as indicated by reference numeral 122 in FIG. 9 is sometimes included in the melt 121. If filling is completed in this state, voids are formed in the molded article by the gas included in the melt 121**.

If injection is carried out in the state where the cavity 118 is arranged so that the disk portion **118*a* is located above, gas is often included in the melt, as indicated above. This disadvantage may be eliminated if the cavity 118 is arranged so that the rim portion 118*b* rises when the disk portion 118*a* is located below. However, if this method is adopted, a hub decorated surface of the product is located on the side of the sleeve 119, and an unnecessary melt-solidified part, called a "biscuit", is formed on this surface. If this part is cut off after molding, the appearance of the decorated surface is degraded. Therefore, according to the conventional technique, molding is always carried out in the state where the disk portion 118*a*** is located above.

According to the conventional technique, molding is carried out in the state where the disk portion **118*a* is located above, as pointed out hereinbefore. Therefore, in order to avoid an inclusion of gas in the melt, the injection must be conducted at a relatively low speed, and thus the productivity is reduced. Inherently, in order to stabilize the quality of the product, the flow manner of the melt 121 in the cavity 118 should be controlled by the speed of the plunger tip 120. However, for the above-mentioned reason, this control is impossible, and the quality cannot be stabilized. If the control is performed by the speed of the plunger tip 120**, the injection speed is elevated and the inclusion of gas is increased.

Where a disk wheel of aluminum is prepared, for example, by such a vertical die casting machine as the above, a gas vent device for a mold is generally used and an annular or circumferential runner communicating with a mold cavity through a plurality of radial gates is arranged between this gas vent device and the mold cavity. When a melt is injected and filled in the cavity, the gas in the cavity and a part of the melt are advanced to the gas vent device through the gates, runner and gas vent passage, and after the gas alone is discharged through a gas vent valve, the gas vent valve is closed by the force of inertia of the melt and the like. When the melt is then coagulated and solidified, the mold is opened and a molded product solidified in the cavity is pushed out to the outside of the cavity by a product push-out apparatus. At this point, a melt-solidified product is formed within the gate, annular runner and gas vent passage, and this melt-solidified product is pushed out simultaneously with the molded product.

In this conventional injection molding apparatus, since the melt-solidified part formed between the annular runner and gates is pushed out simultaneously and integrally with the molded product, the withdrawn molded product must be separated from the melt-solidified part by a hammer or the like. This operation is difficult and reduces the productivity. Furthermore, there is a risk of damage to a part of the product at the separating step. Moreover, at the push-out operation, if the melt-solidified part in the annular runner is moved to the central part of the periphery of the molded product by a cutting separation of the melt-solidified gate part, it is difficult to separate and withdraw the solidified melt runner part from the molded product, and the molded product is often damaged.

SUMMARY OF THE INVENTION

A first object of the present invention is to overcome the above mentioned disadvantage arising in the injection molding for producing a product having a central hole such as a disk wheel.

A second object of the present invention is to overcome the above mentioned disadvantage arising during a separation of the molded product from the solidified melt runner part.

According to the present invention, there is provided, a vertical injection apparatus incorporated with a parting mold composed of mold elements including upper and lower mold halves and defining a cavity to be filled with a melt. The lower mold half has a vertical sleeve hole at the outer side thereof and a vertical melt passage hole communicating between the cavity and the sleeve hole. The upper mold half has a vertically extending pin hole coaxial with the melt passage hole and open to the cavity and provided with a vertically extending mold pin which is movable through the pin hole. At least an upper part of the melt passage hole in the vicinity of the cavity has a diameter smaller than a diameter of the sleeve hole but slightly larger than a diameter of the mold pin so that there is a small circumferential space gap between the mold pin and the melt passage hole. The apparatus comprises an injection sleeve and a plunger therein, means for actuating the injection sleeve to cause the injection sleeve to move toward and be received in the sleeve hole, means for actuating the plunger to cause the plunger to carry out an injection, and means for actuating a movement of the mold pin.

With the apparatus incorporated with the mold as the above, after the melt in the sleeve is injected by the plunger into the cavity through the melt passage hole, the mold pin is forced to move to a lower position so that a lower free end portion of the mold pin is inserted into at least the upper part of the melt passage hole through the cavity, thus urging the melt filled in the cavity and the melt passage hole against the surface of the cavity. The apparatus further comprises means for separating the mold elements from each other and means for holding the mold pin at the lower position thereof at least until the melt is solidified. When the mold pin is upwardly withdrawn or retracted from the lower position and the mold halves are separated from each other, a solidified melt cavity part held in the upper mold half is separated from the other solidified melt parts in the melt passage hole and the injection sleeve by shearing of the solidified melt at a local thin circumferential melt part solidified in the gap between the melt passage hole and the mold pin.

Preferably, the mold pin actuating means comprises means for controlling a force of the mold pin in such a manner that the mold pin moves downwards with an increased force at an initial stage, with a decreased force at an intermediate stage, and with a further increased force at a final stage. Preferably, the cavity is designed for a disk wheel having a central hole through which the mold pin is allowed to pass. A preferred lower mold half forms a contoured inner surface corresponding to a decorated surface of the disk wheel.

The above mentioned parting mold defines, at parting lines thereof, a plurality of gates and a circumferential runner surrounding the cavity and communicating therewith through the gates, and is provided with pin means for pushing the solidified melt parts in the cavity and the runner downwardly out of the upper mold half. Stopper means is provided for holding the solidified melt runner part, while the solidified melt cavity part is pushed out of the upper mold half. Further, there are provided means for releasing the solidified melt runner part, after the solidified melt cavity and gate parts are separated from the upper mold half and the gates with the solidified melt gate parts sheared from the solidified melt runner part, and means for actuating the pin means for pushing the solidified melt runner part after the releasing means is actuated. The stopper means comprises a plurality of radially movable stoppers, each projecting radially into the runner and having a vertically extending hole and having at least a tapered surface part, and the releasing means comprises vertically movable rods. Each rod has a tapered lower end. The tapered stopper holes cooperates with the tapered rod ends to exert a wedge action for withdrawing the stoppers radially out of the runner when the rods move downward into the stopper holes.

The pushing pin means for the solidified melt cavity and runner parts comprises a common horizontal pushing plate which is vertically movable, the pushing pins for the solidified melt cavity part being substantially connected to the pushing plate and extending downwards, and an ejector for actuating a movement of the pushing plate. The pushing plate has first and second chambers having a vertically extending cylindrical form and vertical constricted holes coaxial and communicating with the chambers and opening at the lower surface of the pushing plate. The pushing pins for the solidified melt runner part and the rods have enlarged upper ends received in the first and second chambers, respectively, so as to be movable vertically in the chambers and extending downwards out of the pushing plate through the vertical holes communicating with the chambers. Each first chamber has a first stroke length by which the upper end of the pushing pin for the solidified melt runner part is allowed to move in the first chamber. The first stroke length is substantially longer than a second stroke length of the second chamber, by which the upper end of the rod is allowed to move in the second chamber.

Preferably the first stroke length for each pushing pin for the solidified melt runner part may be twice the second stroke length for each rod, so that one stroke after the pushing pins for the solidified melt cavity part are actuated to remove the solidified melt cavity part from the upper mold half, the rods are actuated to release the stoppers from the solidified melt runner part, and then one stroke after the rods are so actuated, the pushing pins for the solidified melt runner part are actuated to remove the melt runner part from the runner.

DESCRIPTION OF THE PREFERRED EMBODIMENTS

Figure 1:
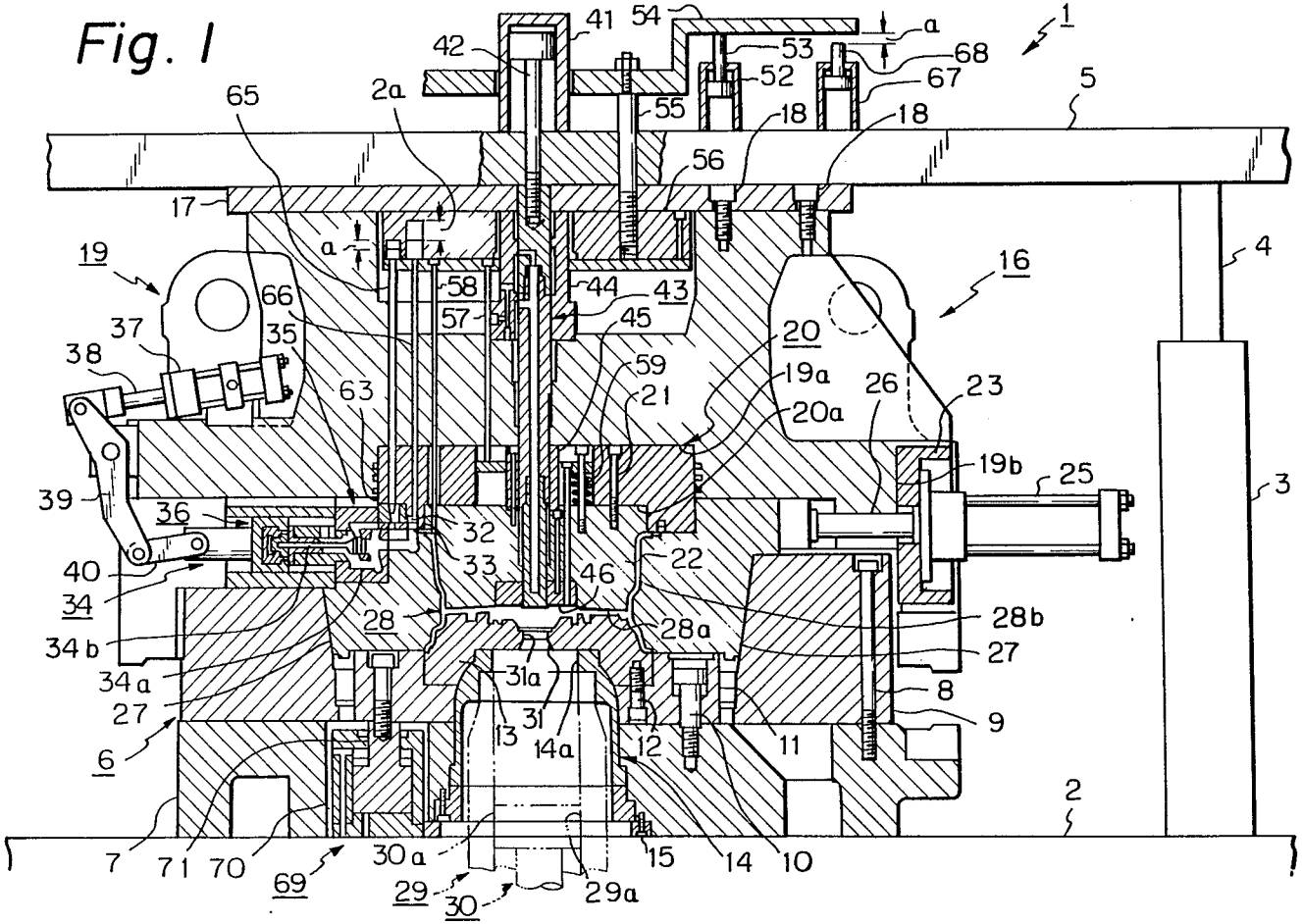
FIG. 1 is a vertically sectional view showing a vertical injection apparatus incorporated with a mold designed for a disk wheel, according to the present invention.

An embodiment of the present invention directed to a rotary die casting machine incorporated with a mold and a mold opening and closing unit will be now described. The rotary die casting machine comprises a rotary table and three sets of mold opening and closing units mounted at positions defined by dividing the outer circumference of the rotary table into three equal parts. On a circulating locus of each mold opening and closing unit circulating with a 120° intermittent rotation of the rotary table, three operation stations are arranged at positions defined by dividing the circumference of the unit into three equal parts. In these three stations, the mold-clamping and injection operation, the mold-opening and product-withdrawing operation and the mold-cleaning and parting agent spraying operation are performed while the table is stopped at every 120° rotation, and one cycle is completed while the table makes one rotation. The mold opening and closing unit stopped at the mold-clamping and injection station is shown in the drawings. A mold-clamping apparatus (not shown) and an injection apparatus (not shown) are arranged above and below FIG. 1, respectively.

Referring to FIGS. 1 to 5, a mold opening and closing unit 1 has an attachment plate 2 dismountably secured onto a rotary table (not shown). A plane top plate 5 is secured to and supported on the operating end of a piston rod 4 to be moved in the vertical direction by an oil pressure of a pair of mold opening and closing cylinders 3 mounted vertically on both the left and right sides of the attachment plate 2. By advance and retreat of the piston rod 4, the top plate 5 and an upper mold half 16 described hereinafter are guided and vertically moved by four guide rods (not shown) to open and close the mold halves. A sleeve-supporting plate 7 of a lower mold represented as a whole by reference numeral 6 is secured to the attachment plate 2. The lower mold half 6 comprises this sleeve-supporting plate 7, an annular core stop ring 9 secured to the sleeve-supporting plate 7 by a plurality of bolts 8, an annular mold holder 11 which is supported by a plurality of guide pins 10 planted in the sleeve-supporting plate 7 so that the mold holder 11 can be vertically moved at small strokes, and a mold proper 13 fitted in the inner circumferential face of the mold holder 11 and secured by a bolt 12. A stepped cylindrical stationary sleeve 14 is inserted in a sleeve hole formed in the three members 7, 11 and 13 of the lower mold half 6, and falling of the sleeve 14 from the sleeve hole is prevented by a ring 15 screwed to the sleeve-supporting plate 7.

A base plate 17 of an upper mold half represented as a whole by reference numeral 16 is secured to the lower surface of the top plate 5, and the upper mold half 16 comprises this base plate 17, a supporting plate 19 substantially octagonal, seen in the horizontal direction, which is integrally secured to the base plate 17 by a plurality of bolts 18, a mold holder 20 fitted and secured into a concave hole 20*a* of the supporting plate 19, and a mold proper 22 fitted in a concave hole 20*a* of the mold holder 20 and secured by a bolt 21. In the lower end flange of the supporting plate 19 having a substantially octagonal shape, concave grooves 19*b* are formed at the centers of four alternate sides of the octagonal shape, and on the end face of each side having the concave groove 19*b* formed thereon, a cylinder supporting plate 23 is secured by a bolt 24 in the state where the bulged portion thereof is engaged with the concave groove 19*b*. Core cylinders 25 having flange portions thereof secured to the four bulged portions, are connected to a compressed oil source and are provided with stroke-regulating limit switches 25*a*. A core 27 is secured to the operating end of a piston rod 26 of each core cylinder 25. In the state shown in FIG. 1, the movement of each core 27 is regulated, but when the lower face of the core 27 exceeds the upper face of the core stop ring 9 by a rising of the entire upper mold 16, all the cores 27 are simultaneously opened in the radial direction by a retreat of the piston rod 26. When the four cores 27 are closed as shown in FIG. 1, a true circle is formed by the inner circumferential faces of the four cores, and a cavity 28 is formed by the upper and lower mold propers 22 and 13 and the four cores 27.

A cylindrical injection sleeve 29 supported through a block on the upper end face of an injection cylinder (not shown) is freely extractably inserted in the inner hole of the stationary sleeve 14, and a plunger tip 30*a* as the head of a plunger 30 to be advanced and retreated by an oil pressure of the injection cylinder is fitted in this inner hole. A runner channel 31 or a melt passage hole is formed between the inner holes 14*a* and 29*a* of both the sleeves 14 and 29 of the same diameter and the cavity 28 as the passage for the melt cast in the inner hole 14*a* and injected into the cavity 28 by an advance of the plunger tip 30*a*. This runner channel 31 or the melt passage hole comprises a gate 31*a* as a cylindrical hole formed on the side close to or in the vicinity of the cavity 28 and having a diameter considerably smaller than the diameter of the inner holes 14*a* and 29*a* and a tapered hole 31*b* formed on the side close to the inner hole 14*a*, and the lower end face of the disk portion 28*a* subsequent to the gate 31*a* corresponds to the decorated surface of the product solidified in the cavity 28.

Figure 2:
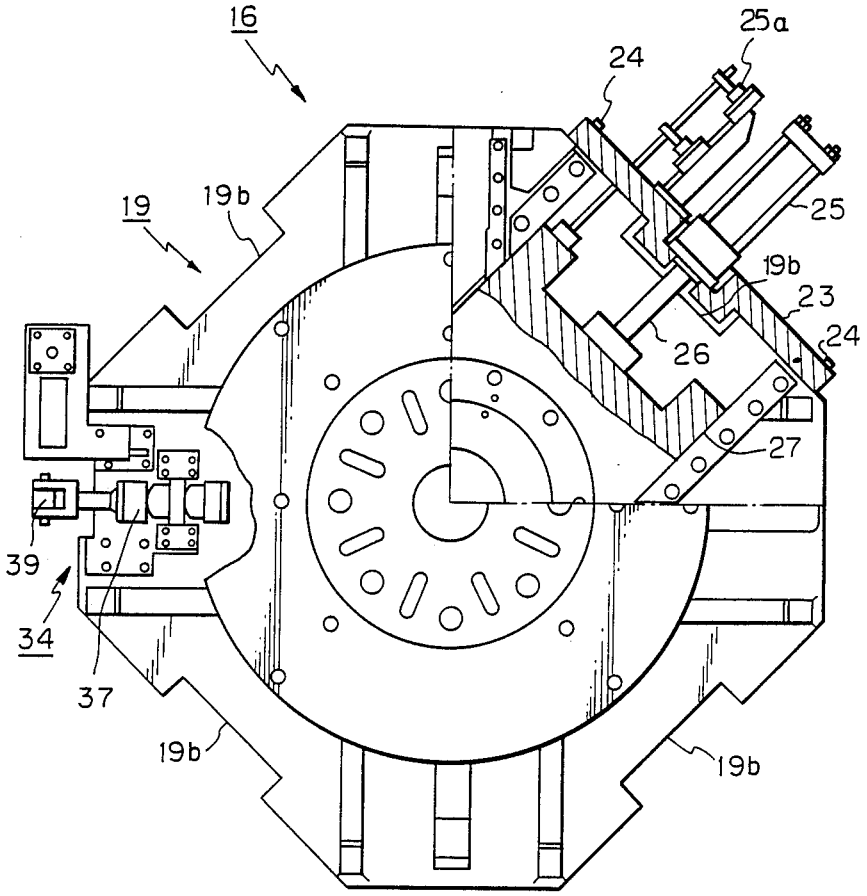
FIG. 2 is a partially cut-out, exploded plane view showing a mold opening and closing unit, without a top plate, provided in the apparatus.
Figure 3:
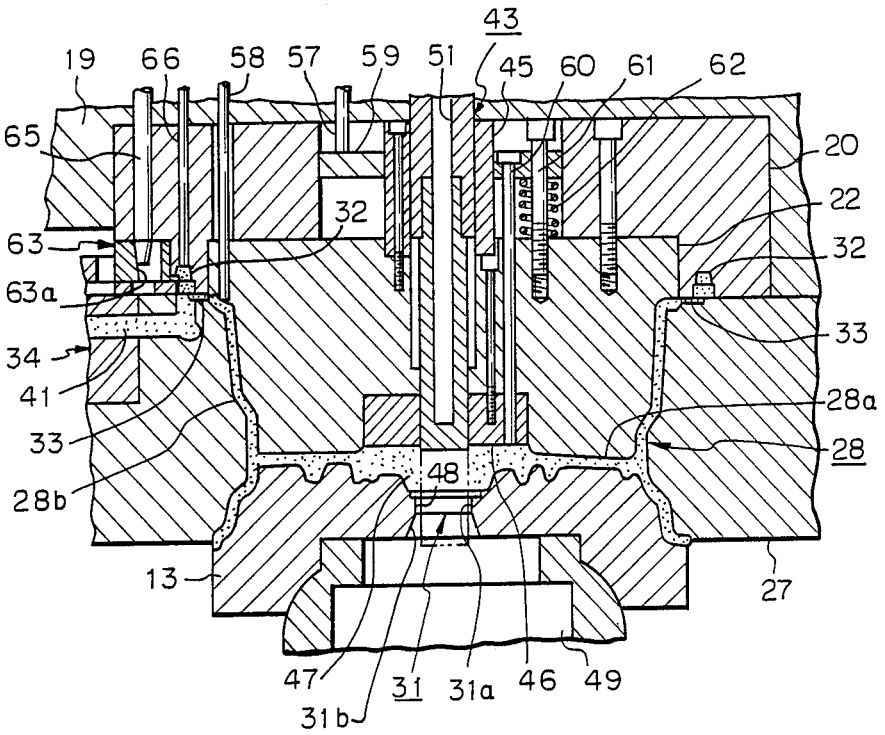
FIG. 3 is an enlarged view showing a longitudinal section of the main part of the apparatus in combination with the mold.

Outwardly of the upper end of the annular rim portion 28*b* of the cavity 28, an annular runner 32 concentric with the rim portion 28*b* is formed on the lower end face of the mold holder 20, and this runner 32 is connected to the rim portion 28*b* through a plurality of radially formed gates 33. Reference numeral 34 represents a gas vent apparatus for discharging gas in the cavity 28 to the outside of the machine at the time of injection, and the gas vent apparatus 34 is located between adjacent cores 27 and arranged between the upper mold half 16 and lower mold half 6, as shown in FIG. 2. This gas vent apparatus 34 is divided into a valve seat portion 35 and a cylinder portion 36. The valve seat portion 35 is divided into a front part and a back part in FIG. 1 and both the parts are opened integrally with the respective cores 27. The cylinder portion 36 is arranged on a piston rod 38 of a gas vent cylinder 37 pivoted on the supporting plate 19 through links 39 and 40 so that the cylinder portion 36 can move in the axial direction. This gas vent apparatus 34 is a known gas vent apparatus disclosed in Japanese Examined Patent Publication No. 59-309 or No. 61-41663, or a known cylinder type gas vent apparatus, comprising a gas passage 34*a* communicating with the runner 32 and a valve 34*b* opening and closing a valve seat portion on the terminal end of the gas passage 34*a*. At the time of injection, the valve 34*b* is opened and gas is discharged by the pressure of the melt or the vacuum suction apparatus and when the valve 34*b* is closed by the force of inertia of the melt or an electric signal, the discharge of the melt outside the valve seat is prevented. The cylinder portion 36 exerts a function of ensuring closing of the valve and maintaining the valve 34*b* at the opening or closing position. When the upper mold 16 is opened, the cylinder portion 36 is retreated from the valve seat portion 35 by the operation of the cylinder 16 to allow an opening and closing thereof and is raised together with the upper mold 16.

The mold-clamping operation and mold-opening operation will now be described. Mold clamping is accomplished from the mold-mated state shown in FIG. 1 by bringing down the top plate 5 against the oil pressure of the mold opening and closing cylinder 3 by the mold-clamping cylinder (not shown). Mold opening accomplished from the state shown in FIG. 1 after retreat of the mold-clamping cylinder by advancing the piston rod 4 of the mold opening and closing cylinder 3 and the top plate 5 is raised integrally with the upper mold half 16, the gas vent apparatus 34 and the like. The product solidified in the cavity or the solidified melt cavity part 28 is raised while adhering to the upper mold half 16 at the time of mold opening.

A device for pushing out the solidified melt cavity part or the molded product and for pushing out the solidified melt runner part 32 at the time of mold opening will now be described. A pin push-out cylinder 41 is secured at the center of the top plate 5 and a piston rod 42 of the cylinder 41 is projected downward through a rod hole of the top plate 5. Reference numeral 43 represents a rod-like mold pin having a screw hole screwed with a projected screw of the piston rod 42 and being extended downward. The mold pin 43 is vertically divided into three steps, for preparation, and these are bonded to one another. The diameter of the lower step is slightly smaller than the diameter of the gate 31*a*. This pin 43 is vertically movably supported in an axial hole formed through a bearing 44 gripped and secured between the base plate 17 and the supporting plate 19, the supporting plate 19, a bearing 45 gripped and secured between the supporting plate 19 and the mold proper 22, the mold proper 22 and a cartridge 46 secured to the mold proper 22. When the piston rod 42 is advanced and retreated by the oil pressure of the pin push-out cylinder 41, the mold pin 43 is vertically moved between positions indicated by the solid line and chain line in FIG. 3. Namely, if before solidification of the melt 47 in the cavity 28, the mold pin 43 is dropped to the position of the chain line, the mold pin 43 puts away the melt 47 and exerts a function of pushing out the melt, and a piercing hole is formed in the gate 31*a* with a circumferential thin solidified melt part 48 left therein. As described hereinafter, the molded product or the melt cavity part is separated from a biscuit 49 by shearing at the solidified melt part 48 at the time of mold opening. Note, a cooling device provided with a hole 51 for cooling water is arranged in the mold pin 43 so that the pin 43 heated by the melt is cooled.

Preferably, the downward movement of the mold pin 43 is actuated by the pin push-out cylinder 41 incorporated with a conventional means for controlling a force of the mold pin 43 such that the pin 43 is forced to move down with an increased force at the initial stage, with a decreased force at an intermediate stage and with a further increased force at a final stage, for the following reasons.

When the mold pin 43 is initiated to move down into the cavity not completely filed with the melt, that is at the initial stage of the pin movement, the melt in the cavity has a semi-solidified outer thin layer melt part formed at the surface of the cavity by locally and initial cooling of the outer melt part in contact with the cavity surface.

In this connection, the pin 43 is required to move down with an increased force sufficient to break the semi-solidified melt layer. The increased force is obtained by increasing an oil pressure for actuating the cylinder 41. If such an increased force is maintained during the entire pin movement, it will cause the melt in the cavity to be locally subjected to abnormally high pressure with the result that a molded product will be locally cracked. That is, the pin 43 with the increased force will probably drag some pieces of the semi-solidified melt layer broken with a lower free end portion of the pin 43 into the interior of the melt cavity part, with the result that a molded product has cracks at the upper surface. Further, if the increase force is maintained, while the pin end is moving into the melt cavity part, the pin 43 excessively overcomes the resistance of the melt cavity part such that it moves forwards at an excessively high speed. This obstructs the entry of an additional part of the melt to the cavity from the injection sleeve, which melt part amounts to a volume sufficient to compensate for a condensation of the melt in the cavity due to the solidification of the melt. As a result, the mold pin 43 does not urge the melt against the cavity surface as desired. In this regard, preferably the force of the mold pin 43 is decreased, when the pin 43 first invades the melt cavity part, to such an extent that the additional melt part amounting to a volume sufficient to compensate for a condensation of the melt cavity part is allowed to enter the cavity, but an abnormally increased pressure is not applied locally to the melt cavity part in a process of solidification.

When the pin 43 invades the gate or the melt passage hole 31*a*, the pin 43 must cause the melt cavity part to be sheared at the circumferential or annular thin melt part between the pin 43 and the gate 31*a* from the other melt part 81, so called "biscuit". Therefore, at this final stage, it is preferably to increase the force of the pin 43.

In a case where solidification of the melt occurs in a relatively short period of time, the melt pin may be actuated so as to have an increased force after a predetermined period of time from the injection of the melt, by using a timer means.

Further, another mode of the mold pin operation may be adopted, wherein the force of the mold pin 43 is intermittently, one or several times decreased while the pin 43 is moving forward.

A plurality of product push-out cylinders 52 are secured to the top face of the top plate 5, and ejector plates 54 are secured and supported on the top ends of piston rods 53 of the cylinders 52 in parallel to the top plate 5. A plurality of pins 55 secured to the ejector plates 54 are projected downward through holes of the top plate 5 and base plate 17, and are screwed into screw holes of a push-out plate 56 or a common horizontal pushing plate arranged vertically movably in a space portion of the supporting plate 19. A plurality of push-out pins 57 and 58, which hang down with the heads gripped by the push-out plate 56 divided into upper and lower parts, have lower ends thereof fitted to the upper end of the rim portion 28*b* and a hub push-out plate 59 arranged vertically movably in a space portion of the mold holder 20. If the product push-out cylinders 52 are actuated after mold opening to drop the ejector plates 54, the product is pushed out downward from the cavity 28 by means of the pins 55, the push-out plate 56, the push-out pins 57 and 58, the hub push-out plate 59 and a push-out pin 60 supported by the hub push-out plate 59 and fitted to the hub portion 28*a*. Note, the hub push-out plate 59 is vertically moved while being guided by a guide pin 61 and is returned to the raised position by an elastic force of a compression coil spring 62.

Figure 4:
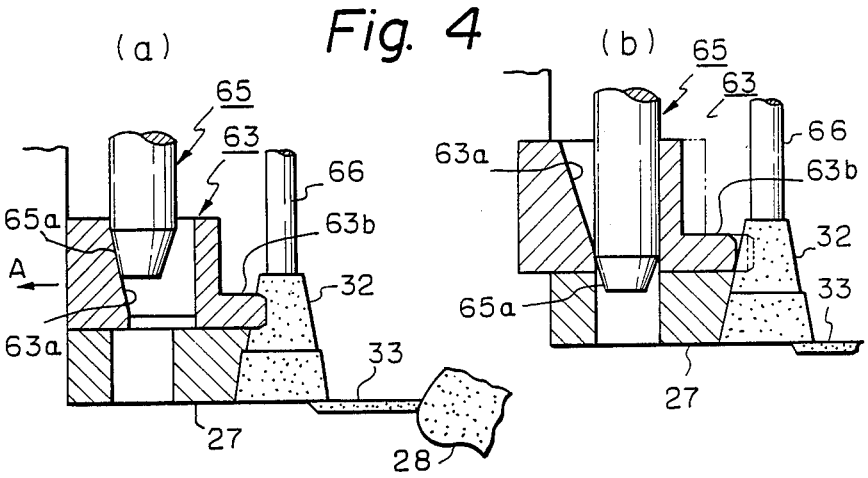
FIG. 4(*a*) and FIG. 4(*b*) show a combination of a stopper means and a releasing means for a solidified melt runner part, provided in the apparatus.
Figure 5A:
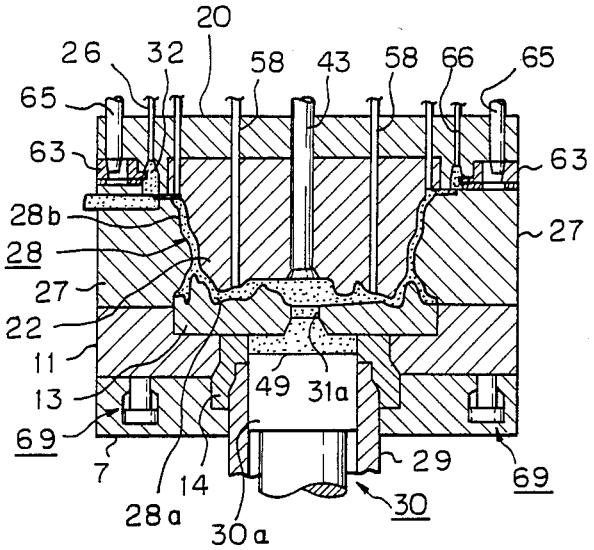
FIG. 5(*a*) to FIG. 5(*f*) show molding operations in time series for injecting a melt into a cavity and separating solidified melt parts in the cavity, gates and a runner formed in the mold therefrom, to be carried out in the apparatus.
Figure 5B:
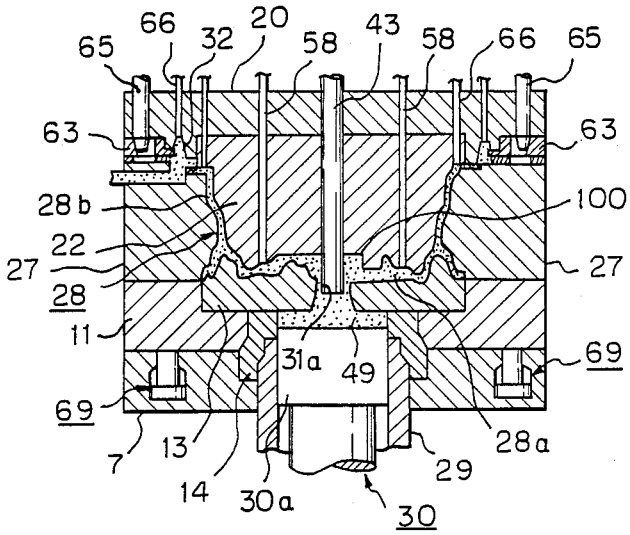
Figure 5C:
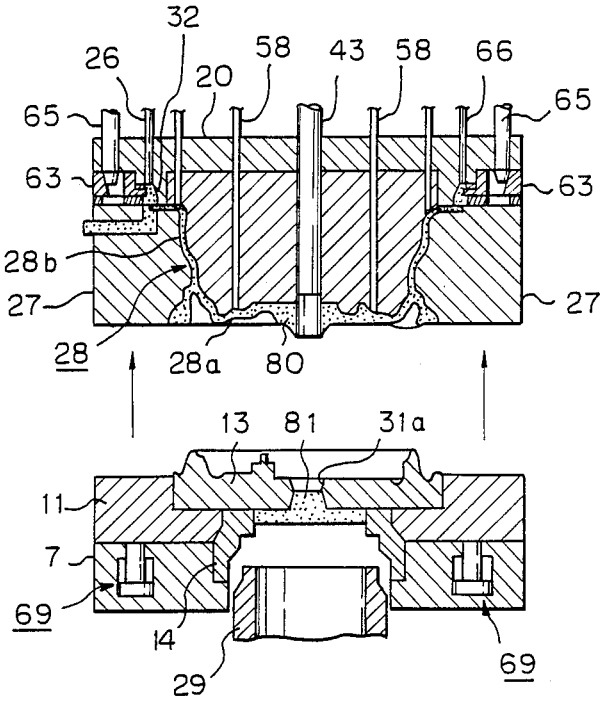
Figure 5D:
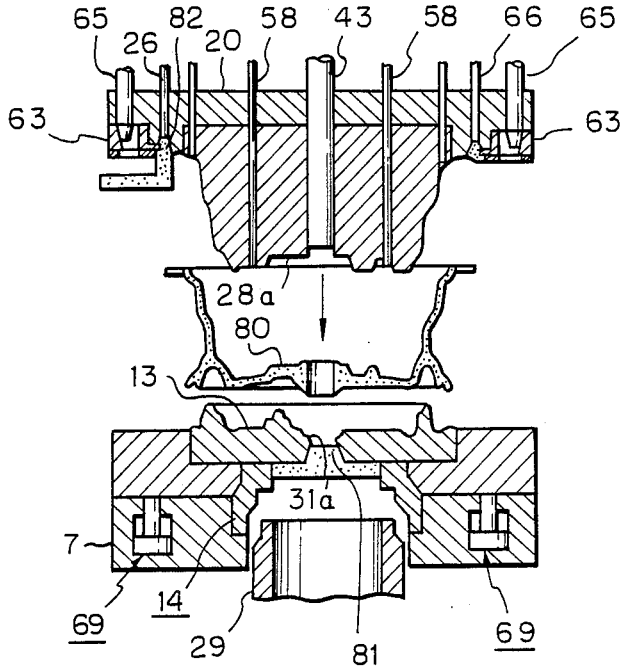
Figure 5E:
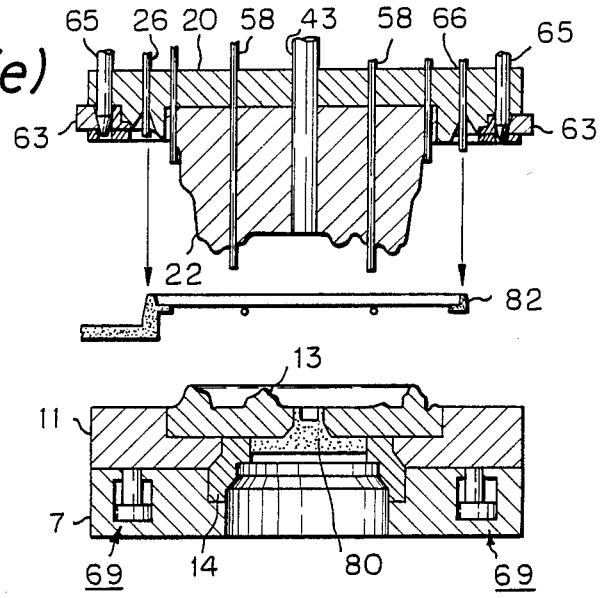
Figure 5F:
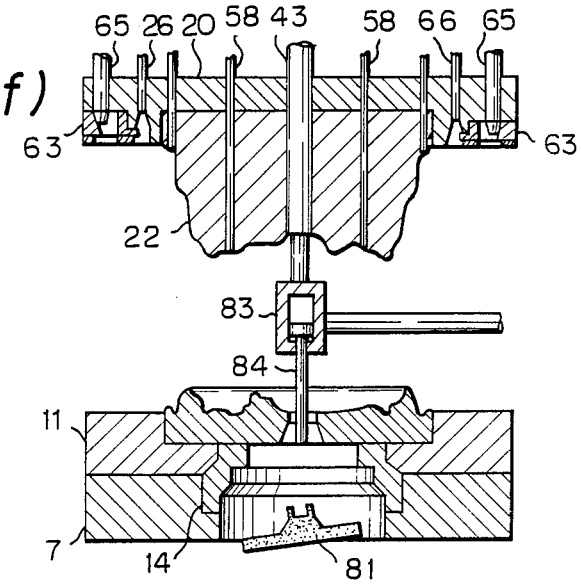
Figure 6:
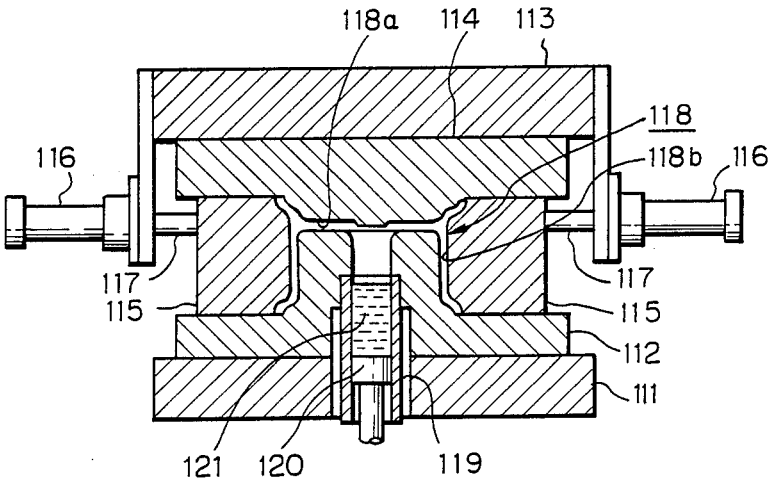
Fig. 6 PRIOR ART
FIG. 6 is a vertically sectional view of a main part of a conventional apparatus incorporated with a conventional mold for comparison with these of the present invention.
Figure 7:
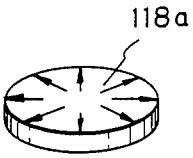
FIGS. 7 and 8 are diagrammatic perspective views showing a disk portion and a circumferential rim portion of the cavity as shown in FIG. 6 with arrows indicating melt flows in these cavity portion, respectively.
Figure 8:
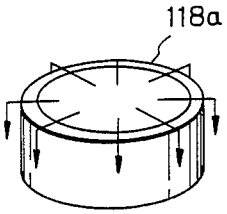
Figure 9:
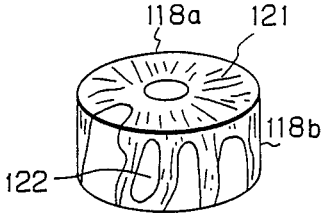
FIG. 9 is a diagrammatic perspective view showing the state of the melt flow in the cavity as shown in FIG. 6.

A plurality of columnar stoppers 63 are fitted in holes formed equidistantly in the circumferential direction on the peripheral lower end of the mold holder 20 so that the stoppers 63 are advanced and retreated in the radial direction indicated by arrow A in FIG. 4. The top end inclined face 65*a* of each rod 65 hanging down under its own weight from the push-out plate 56 is engaged in an inclined or tapered hole 63*a* formed in each stopper 63. When the push-out plate 56 is brought down by a stroke indicated by a in FIG. 1, the push-out plate 56 is integrated with the rod 65 and when the rod 65 begins to drop, the stoppers 63 are simultaneously moved in the direction of arrow A by the action of the inclined hole 63*a* and inclined face 65*a*. The lower end of each of push-out pins 66 supported at positions equidistantly defined in the peripheral portion of the push-out plate 56 and hanging down therefrom abuts against the melt runner part 32, and a circular projection 63*b* formed in the stopper 63 is freely extractably inserted in the concave hole of the runner 32 to hold the solidified melt runner part in the runner 32. When the push-out plate 56 is further brought down by a stroke indicated by 2*a* in FIG. 1, the push-out pin 66 beings to drop. If the push-out plate 56 begins to drop while the projection 63*b* is inserted therein, the molded product is first pushed out by the push-out pins 58 and 60 and is sheared from the solidified melt runner part at the solidified melt gate part 33, and the annular solid or the solidified melt runner part is left in the runner 32 in the state held by the projection 63*b* of the stopper. Then, the stopper 63 is moved at stroke a as described above, and at stroke 2*a* the solid in the runner 32 is pushed out. Reference numeral 67 in FIG. 1 represents a push-out timing-regulating cylinder secured to the top face of the top plate 5, and a clearance a equal to stroke a is formed between a piston rod 68 at the uppermost position and the ejector plate 54. When the ejector plate 54 drops and abuts against the piston rod 68, by the controlling action of an electromagnetic valve or the like, dropping is once stopped and then performed again. Namely, this stop position is the drop-starting position of the rod 65 and the position where the product is pushed out by a. If this structure is adopted, push-out of the runner 32 turning round below the product is avoided, the difficult operation of taking out the product from the solidified melt runner part is not necessary, and damage to the molded product by taking out the solidified melt runner part can be avoided. Reference numeral 69 in FIG. 1 represents a push-up cylinder comprising a cylinder 70 secured to the side of the attachment plate 2 and a piston 71 secured to the side of the lower mold. If the solidified melt thin part in the gate 31*a* is not sheared due to a mis-shot, the push-up cylinder 69 is actuated to push up the mold holder 11 and the mold proper 13, whereby accidents are prevented.

The operation of the vertical injection apparatus will now be described with reference to FIGS. 1 through 4 and FIG. 5 illustrating the operation. The mold opening and closing unit 1, where spraying of a parting agent and mating of the molds have been performed in the operation station of the upstream side, is turned to the mold-clamping and injection station by the turning movement of the table and stopped at the station. Mold clamping is accomplished by pressing the top plate 5 downward by the mold-clamping cylinder. Simultaneously with mold clamping, the injection sleeve 29, in which the melt 49 has been cast, is fitted in the inner hole of the stationary sleeve 14 and is coupled therewith. If the plunger tip 30*a* is advanced in this state, the melt 49 is injected and filled in the cavity 28. FIG. 5-(*a*) shows the state at completion of the injection. Just before or just after completion of the injection, that is, before solidification of the melt 69 begins, the piston rod 42 of the pin push-out cylinder 41 is advanced by the oil pressure, whereby the mold pin 43 is brought down, projected from the cartridge 46, and pushed into the melt 49 in the gate 31*a* as shown in FIG. 5-(*b*). At this point, the melt 49 in the gate 31*a* is discharged by the mold pin 43 but is caused to flow in the cavity 28. Therefore, the melt-pushing action is exerted and the melt 49 extends to all corners of the cavity 28. In this state, solidification of the melt 49 begins and after the lapse of a predetermined time, solidification is completed and a product is obtained. When the rotary table is further turned by 120° and the mold opening and closing unit 2 stops at the product withdrawal station, the piston rod 4 is advanced by the oil pressure of the mold opening and closing cylinder 3 to raise the top plate 5. Accordingly, the upper mold 16 as a whole rises integrally with the top plate 5 and mold opening is performed, as shown in FIG. 5-(*c*). In this case, since the mold pin 43 is inserted in the gate 31*a*, as described hereinbefore, and the difference of the diameter between the gate 31*a* and the mold pin 43 is small, a circumferential thin cylindrical solidified melt part is formed around the pin 43. Therefore, the molded product 80 in the cavity 28 rising while adhering to the upper mold half 16 is easily sheared at the above-mentioned thin cylindrical solid while leaving the biscuit 81 in the stationary sleeve 14 and the tapered or inclined hole 31*b*, and the product 80 rises together with the upper mold half 16. After this mold opening, if the piston rod 53 is retreated by the oil pressure of the product push-out cylinder 52, the push-out plate 56 begins to drop through the pin 55. Accordingly, the push-out pins 57 and 58 integrated with the push-out plate 56 first drop, and the product 80 against which the pins 57 and 58 impinge is pushed out from the cavity 28 At this point, as shown in FIG. 4-(*a*), the projection 63*b* of the stopper 63 is engaged with the concave hole of the runner 32, and therefore, even if the product 80 is pushed out and brought down, the solidified melt runner part 82 in the runner 32 is kept as it is, and thus the product or the solidified melt cavity part 80 is separated from the solidified melt runner part 32 at the solidified melt gate part 33 by shearing thereof. FIG. 5-(*d*) shows the state where only the product 80 is pushed out but the solid 82 in the runner 32 is left. When the push-out plate 56 is brought down by stroke a, since the push-out plate 56 abuts against the top end of the piston rod 68 of the cylinder 67, dropping is once stopped, and after the lapse of a predetermined time, the push-out plate 56 begins to drop again. At the time of dropping re-start, since a part of the interior of the push-out plate 56 is in contact and integrated with the rod 65 at stroke a, also the rod 65 drops. With the dropping of the rod 65, the lower end inclined or tapered face 65*a* of the lower rod end portion presses the inclined hole 63*a* of the stopper 63, and the stopper 63 is moved in the direction of arrow A due to a wedge action exerted by cooperation of the stopper 63 and the rod 65. As a result, the projection 63*b* is extracted from the concave hole of the runner 32. When the push-out plate 56 further drops by another stroke a and the push-out plate 56 drops by 2*a* as a whole, the push-out plate 56 becomes integrated with the push-out pin 66. Therefore, also the push-out pin 66 begins to drop and the solid 82 in the annular runner 32 against which the lower end of the push-out pin 66 abuts is pushed out. This state is illustrated in FIG. 5-(*e*). Then, as shown in FIG. 5-(*f*), a push-out apparatus 83 is moved between the opened mold halves, and if a piston rod 84 is advanced, the biscuit 81 is pushed out.

Note, when the push-out operation is carried out by first moving the push-out pins 57 and 58 by stroke a, the solid is still left in the annular runner 32 on the mold side. Accordingly, before the solid in the annular runner 32 is pushed out, the molded product is taken out to the outside from between the molds halves, or a receiving plate for receiving the solid in the annular runner 32 is disposed above the collected product.

Where the product 80 thus withdrawn from the mold is a disk wheel, the lower side of the hub in the drawings is the decorated surface, and since only the thin circumferential solid adheres to this surface, this thin solid can be easily removed and the appearance is not degraded by removal of this thin solid.

Note, the above embodiment of the present invention is directed to the rotary die casting machine, but of course, the present invention can be similarly applied to a stationary die casting machine. Moreover, the present invention can be applied to an injection molding machine for plastics.

Furthermore, in the present example, a gas vent apparatus for the molds is used. However, obviously the present invention can be applied to any apparatuses having a circumferential runner formed in a mold.

As is apparent from the foregoing description, in the vertical injection apparatus of the present invention, the diameter of a melt passage formed between an injection sleeve-inserting hole of a lower mold half and a mold cavity at least at a part closer to the mold cavity is smaller than the diameter of the inner hole of the injection sleeve, and a mold pin which is freely extractably fitted into the small-diameter part of the melt passage and has a diameter of the fitting portion slightly smaller than the diameter of said small-diameter part is vertically movably supported on an upper mold half. In this structure, even if a part having a diameter smaller than the diameter of the injection sleeve is formed in the melt passage, only a thin solid is formed at this part by dint of the action of the mold pin, and at the time of mold opening, the molded product can be easily sheared and separated from the biscuit. Accordingly, a disk wheel having a reduced hub portion can be obtained without degradation of the appearance of the decorated surface. Therefore, an inclusion of gas in the melt injected is avoided and the quality of the product is highly improved. Furthermore, reduction of the injection speed for avoiding an inclusion of gas is not necessary, and therefore, the productivity is improved. Moreover, since the melt in the small-diameter part is removed by the mold pin into the cavity, the action of pushing out the melt or urging the melt against the cavity surface is exerted and the melt extends to all corners of the cavity, with the result that the quality of the product is improved.

Further, according to the present invention, a method is adopted for pushing out a solid formed in an annular runner in an injection molding machine, which is characterized in that only a cast product in the mold cavity is separated from the solid in the annular runner and pushed out in the state where the solid in the annular runner is held by a stopper member to prevent the solid in the annular runner from being pushed out from the annular runner, and after the lapse of a predetermined time, the solid in the annular runner is released from the stopper member, and the solid in the annular runner is pushed out. There is also provided a device for pushing out a solid in an annular runner in an injection molding apparatus, characterized in that the device comprises: a stopper which is supported so that the stopper can advance and retreat in such a manner that the top end of the stopper is inserted into the annular runner from the peripheral side and is extracted therefrom; a stopper draw-out rod which is supported on a cast product push-out plate while the inclined face of the top end of the rod is engaged with an inclined hole of the stopper and which advances integrally with the cast product push-out plate after the lapse of a certain time from the point of start of push-out of the cast product; and a pin for pushing out a solidified product formed in the annular runner, which is supported on said push-out plate in parallel to the stopper draw-out rod so that the top end of the pin is exposed to the annular runner, which pin advances integrally with the push-out plate after the lapse of a certain time from the point of start of the advance of the stopper draw-out rod. By dint of the structural features, in the present invention, when the push-out plate is advanced for pushing out the product, since the solid in the annular runner is held by the stopper, only the product is pushed out, and after the lapse of a certain time, the stopper is opened and the solid in the annular runner is pushed out. Accordingly, it is not necessary to separate the solid in the runner from the product after the product has been taken out from the machine, and the operation efficiency is improved, with the result that labor can be saved and the productivity can be improved. Moreover, damage of the product can be avoided at the time of separation of the molded product from the mold.

By the way, when the solidified melt runner part is separated prior to or simultaneously with the molded product from the mold, it is likely to be moved toward the molded product and to attack against the surface of the molded product. According to the present invention, however such a attacking against the molded product due to the melt running part with damage to the product can be avoided. Further, the troublesome manual operation of removing the solidified melt part from the molded product can be omitted with the result that the operation efficiency is improved.

We claim:

1. A vertical injection apparatus incorporated with a parting mold composed of mold elements comprising:

an upper mold half and a lower mold half having an outer side;

a mold pin having a lower free end portion and having an outer side, said mold pin being vertically movable between an upper position and a lower position, said mold pin at said upper position defining with said upper mold half and said lower mold half an initial cavity for receiving an injected melt, said mold pin at said lower position defining with said upper mold half and said lower mold half a final cavity forming a contour of a molded product;

a vertical sleeve hole at the outer side of said lower mold half;

a vertical melt passage hole communicating between the initial cavity and the sleeve hole, at least an upper part of the melt passage hole adjacent the initial cavity having a diameter smaller than a diameter of the sleeve hole but larger than a diameter of said mold pin for forming circumferential gap between said mold pin at the lower position thereof and the melt passage hole;

a vertically extending pin hole in said upper mold half coaxial with the melt passage hole and open to the initial cavity, said mold pin being provided to vertically move through the pin hole;

an injection sleeve having a plunger slidable therein for injecting melt into said initial cavity;

means for actuating the injection sleeve to cause the injection sleeve to move toward and be received in the sleeve hole;

means for actuating the plunger to cause the plunger to carry out an injection; and means for actuating a movement of said mold pin between the upper and lower positions wherein after the melt in the sleeve is injected by the plunger into the initial cavity through the melt passage hole, said mold pin is forced to move from the upper position to the lower position so that a lower free end portion of said mold pin is inserted into at least the upper part of the melt passage hole through the initial cavity, thus urging the melt supplied in both the initial cavity and the melt passage hole against the surface of the initial cavity, and changing the melt in the initial cavity into the molded product in the final cavity.

2. A vertical injection apparatus according to claim 1, further comprising means for separating the mold elements from each other and means for holding the mold pin at the lower position thereof at least until the melt is solidified, wherein, when the mold pin is upwardly withdrawn from the lower position and the mold halves are separated from each other, a solidified melt cavity part held in the upper mold half is separated from other solidified melt parts in the melt passage hole and the injection sleeve by shearing of the solidified melt at a local thin circumferential melt part solidified in the gap between the melt passage hole and the mold pin.

3. A vertical injection apparatus according to claim 2, wherein the cavity is designed for a disk wheel having a central hole through which the mold pin is allowed to pass.

4. A vertical injection apparatus according to claim 3, wherein the lower mold half forms a contoured inner surface corresponding to a decorated surface of the disk wheel.

5. A vertical injection apparatus according to any one of claims 1, 2, 3, or 4, wherein the mold pin actuating means comprises means for controlling a force of the mold pin in such a manner that the mold pin moves downwards with an increased force at an initial stage, with a decreased force at an intermediate stage, and with a further increased force at a final stage.

6. A vertical injection apparatus according to any one of claims 1, 2, 3, or 4, wherein the parting mold defines, at parting lines thereof, a plurality of gates and a circumferential runner surrounding the cavity and communicating therewith through the gates, and is provided with pin means for pushing the solidified melt parts in the cavity and the runner downwardly out of the upper mold half; stopper means for holding the solidified melt runner part, while the solidified melt cavity part is pushed out of the upper mold half; means for releasing the solidified melt runner part, after the solidified melt cavity and gate parts are separated from the upper mold half and the gates with the solidified melt gate parts sheared from the solidified melt runner part; and means for actuating the pin means for pushing the solidified melt runner part after the releasing means is actuated.

7. A vertical injection apparatus according to claim 6, wherein the stopper means comprises a plurality of radially movable stoppers, each projecting radially into the runner and having a vertically extending hole and having at least a tapered surface part, and the releasing means comprises vertically movable rods, each having a tapered lower end, the tapered stopper holes cooperating with the tapered rod ends to exert a wedge action for withdrawing the stoppers radially out of the runner when the rods move downward into the stopper holes.

8. A vertical injection apparatus according to claim 7, wherein: the pushing pin means for the solidified melt cavity and runner parts comprises a common horizontal pushing plate which is vertically movable, the pushing pins for the solidified melt cavity part being substantially connected to the pushing plate and extending downwards, and an ejector for actuating a movement of the pushing plate; the pushing plate having first and second chambers having a vertically extending cylindrical form and vertical constricted holes coaxial and communicating with the chambers and opening at the lower surface of the pushing plate; the pushing pins for the solidified melt runner part and the rods having enlarged upper ends received in the first and second chambers, respectively, so as to be movable vertically in the chambers and extending downwards out of the pushing plate through the vertical holes communicating with the chambers; each first chamber having a first stroke length, by which the upper end of the pushing pin for the solidified melt runner part is allowed to move in the first chamber, said first stroke length being substantially longer than a second stroke length of the second chamber, by which the upper end of the rod is allowed to move in the second chamber.

9. A vertical injection apparatus according to claim 8, wherein the first stroke length for each pushing pin for the solidified melt runner part is twice the second stroke length for each rod, so that one stroke after the pushing pins for the solidified melt cavity part are actuated to remove the solidified melt cavity part from the upper mold half, the rods are actuated to release the stoppers from the solidified melt runner part, and then one stroke after the rods are so actuated, the pushing pins for the solidified melt runner part are actuated to remove the melt runner part from the runner.

10. A vertical injection apparatus according to claim 1, wherein the mold pin is inserted into the upper part of the melt passage hole to shear a solidified melt part formed around the pin in the upper part from the molded product.

* * * * *

UNITED STATES PATENT AND TRADEMARK OFFICE

CERTIFICATE OF CORRECTION

PATENT NO. : 4,840,557

DATED : June 20, 1989

INVENTOR(S) : Kenji Ishimoto and Kouji Kawabata

It is certified that error appears in the above-identified patent and that said Letters Patent is hereby corrected as shown below:

In the Abstract, line 12, change "large than the" to --larger than the diameter--.

Signed and Sealed this

Thirteenth Day of March, 1990

*Attest:*

JEFFREY M. SAMUELS

*Attesting Officer*

*Acting Commissioner of Patents and Trademarks*